US007640710B1

(12) United States Patent
McAtee

(10) Patent No.: US 7,640,710 B1
(45) Date of Patent: Jan. 5, 2010

(54) METHOD FOR REPLACING A LOUVERED PANEL MOUNTED IN A FINISHED OPENING

(76) Inventor: Joseph P. McAtee, 1613 Thistlewood Dr., Washington Crossing, PA (US) 18977

( * ) Notice: Subject to any disclaimer, the term of this patent is extended or adjusted under 35 U.S.C. 154(b) by 461 days.

(21) Appl. No.: 11/438,980

(22) Filed: May 24, 2006

(51) Int. Cl.
*E06B 7/08* (2006.01)

(52) U.S. Cl. ..... 52/745.16; 52/198; 52/514; 52/473; 454/277; 454/284; 454/370

(58) Field of Classification Search ..... 52/198, 52/199, 202, 473, 514, 741.3, 741.4; 454/277, 454/284, 370
See application file for complete search history.

(56) References Cited

U.S. PATENT DOCUMENTS

| | | | | | |
|---|---|---|---|---|---|
| 2,716,784 | A * | 9/1955 | Kuyper | 52/204.705 |
| 3,803,779 | A * | 4/1974 | Kuyper et al. | 52/99 |
| 4,230,416 | A * | 10/1980 | Gilb | 403/232.1 |
| 4,592,271 | A * | 6/1986 | Young | 454/277 |
| 4,738,191 | A | 4/1988 | Porter | 98/121.1 |
| 5,269,861 | A * | 12/1993 | Gilbreath | 156/98 |
| 5,487,701 | A * | 1/1996 | Schedegger et al. | 454/271 |
| 6,012,260 | A * | 1/2000 | Hendrick et al. | 52/302.1 |
| 6,113,488 | A * | 9/2000 | Tiede | 454/276 |
| 2005/0003755 | A1 * | 1/2005 | Koessler | 454/359 |
| 2006/0010817 | A1 * | 1/2006 | Shull | 52/514 |
| 2007/0204530 | A1 * | 9/2007 | Janesky | 52/169.14 |

* cited by examiner

*Primary Examiner*—Robert J Canfield
*Assistant Examiner*—Patrick Maestri
(74) *Attorney, Agent, or Firm*—LaMorte & Associates

(57) ABSTRACT

A replacement ventilation cover and its method of installation in place of an old damaged ventilation cover. The replacement ventilation cover has a peripheral frame and an air permeable structure contained within the interior of the peripheral frame. Guides are prefabricated in the peripheral frame. The Guides hold nails or screws at acute angles relative to the plane of the opening being covered. To utilize the replacement ventilation cover, a central portion of the damaged ventilation cover is removed. This creates an opening without having to remove the nailing flange of the damaged ventilation cover. Consequently, the siding and trim around the vent opening does not have to be disturbed. The replacement ventilation cover is inserted into the remnants of the damaged ventilation cover. Nails or screws are then driven through the guides and into the construction under the old ventilation cover.

15 Claims, 5 Drawing Sheets

METHOD FOR REPLACING A LOUVERED PANEL MOUNTED IN A FINISHED OPENING

BACKGROUND OF THE INVENTION

1. Field of the Invention

In general, the present invention relates to louvered or slatted panels that are used to cover ventilation openings in buildings. More particularly, the present invention relates to louvered or slatted replacement panels that can be retroactively installed into an existing opening.

2. Prior Art Statement

Many forms of construction contain attic crawl spaces. In order to prevent these crawl spaces from becoming overly hot during the summer, the crawl spaces are commonly vented to the outside. The venting allows fresh air to flow into the crawl space, thereby preventing any excessive build up of heat.

One common technique used to vent attic crawl spaces is to provide a vent opening with a louvered cover. A louvered cover is a cover comprised of closely placed parallel slats. The slats are inclined and overlap to prevent rain from passing into the louvered cover. The tight spacing of the slats prevents birds, squirrels and other animals from passing into the vent opening. Screening is stretched behind the louvers to prevent insects from passing. Although the louvered configuration prohibits water and animals from entering a vent opening, the louvered configuration enables air to freely flow, thereby allowing for good ventilation.

Louvered covers for attic vent openings have been used in the construction of buildings for hundreds of years. Early louvered covers were made from thin wooden slats. However, wooded slats tended to weather quickly and rot if not regularly maintained. In modern construction, louvered vent covers are typically molded from plastic. In this manner, the material of the louvered vent cover is inherently resistant to weathering.

Modern louvered vent covers are typically manufactured for new construction applications. That is, modern louvered vent covers are molded with a peripheral nailing flange. The nailing flange is a thin flange of plastic that extends outwardly from the periphery of the louvered vent cover. The nailing flange is larger than the vent opening. The nailing flange lays flush against the new construction of the wall that surrounds the vent opening. Nails are then driven through the nailing flange to hold the overall louvered vent covering in place. The louvered vent covering is nailed over a rough opening during construction. In this manner, the building's siding and trim can be installed around the louvered vent opening, thereby hiding the nailing flange. Prefabricated louvered vents covered with nailing flanges are exemplified by U.S. Pat. No. 4,592,271 to Young, entitled Louvered Vent, and U.S. Pat. No. 4,738,191 to Porter, entitled Aluminum Air Vent Louver.

Although plastic louvered vent covers are weather resistant, nothing lasts forever. As plastic is exposed to the ultraviolet radiation of the sun, the plastic degrades over time and becomes brittle. Furthermore, wind, snow and ice repeatedly stress the louvers in the louvered vent cover, causing fatigue in the plastic. Eventually, plastic louvered vent covers break and require replacement.

A problem occurs when a plastic louvered vent cover requires replacement. In order to place a new prior art louvered vent cover into place, the trim and siding surrounding the vent opening needs to be removed to make room for the nailing flange of the replacement cover. This is a very expensive and labor intensive endeavor. Alternatively, a contractor can nail the nailing flange over the top of a sided wall. This installation technique is quick and easy but makes the louvered vent cover unsightly. Furthermore, since the installation procedure is improvised, the plastic material of the louvered vent cover can be cracked by the random nail or screw insertion. The result is an unsecured louvered vent cover that can be displaced during a storm or other weather event.

A need therefore exists for a replacement louvered vent cover that can be retroactively added to an existing finished vent opening without the need for removing surrounding trim and siding. A need also exists for such a louvered vent cover that is configured to be securely anchored into position without the need of an exposed nailing flange. These needs are met by the present invention as described and claimed below.

SUMMARY OF THE INVENTION

The present invention is a replacement ventilation cover and its method of installation in place of an old damaged ventilation cover. The replacement ventilation cover has a peripheral frame and an air permeable structure contained within the interior of the peripheral frame. Guides are prefabricated in the peripheral frame. The guides hold nails or screw at acute angles relative to the plane of the opening being covered.

To utilize the replacement ventilation cover, a central portion of the old, damaged ventilation cover is removed. This creates an opening without having to remove the nailing flange of the old ventilation cover. Consequently, the siding and trim around the vent opening does not have to be disturbed. The replacement ventilation cover is inserted into the remnants of the old ventilation cover. Nails or screws are then driven through the nail guides and into the construction under the old ventilation cover. The result is a new ventilation cover that is securely installed in a rapid fashion without disturbing the wall features surrounding the vent opening.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention louvered vent cover can be used to cover many types of vent openings, such as round vent openings and triangular vent openings, the exemplary embodiment of the invention is shown covering a rectangular vent opening. The selection of such a shape is merely arbitrary and should not be considered a limitation to the invention.

Figure 1:
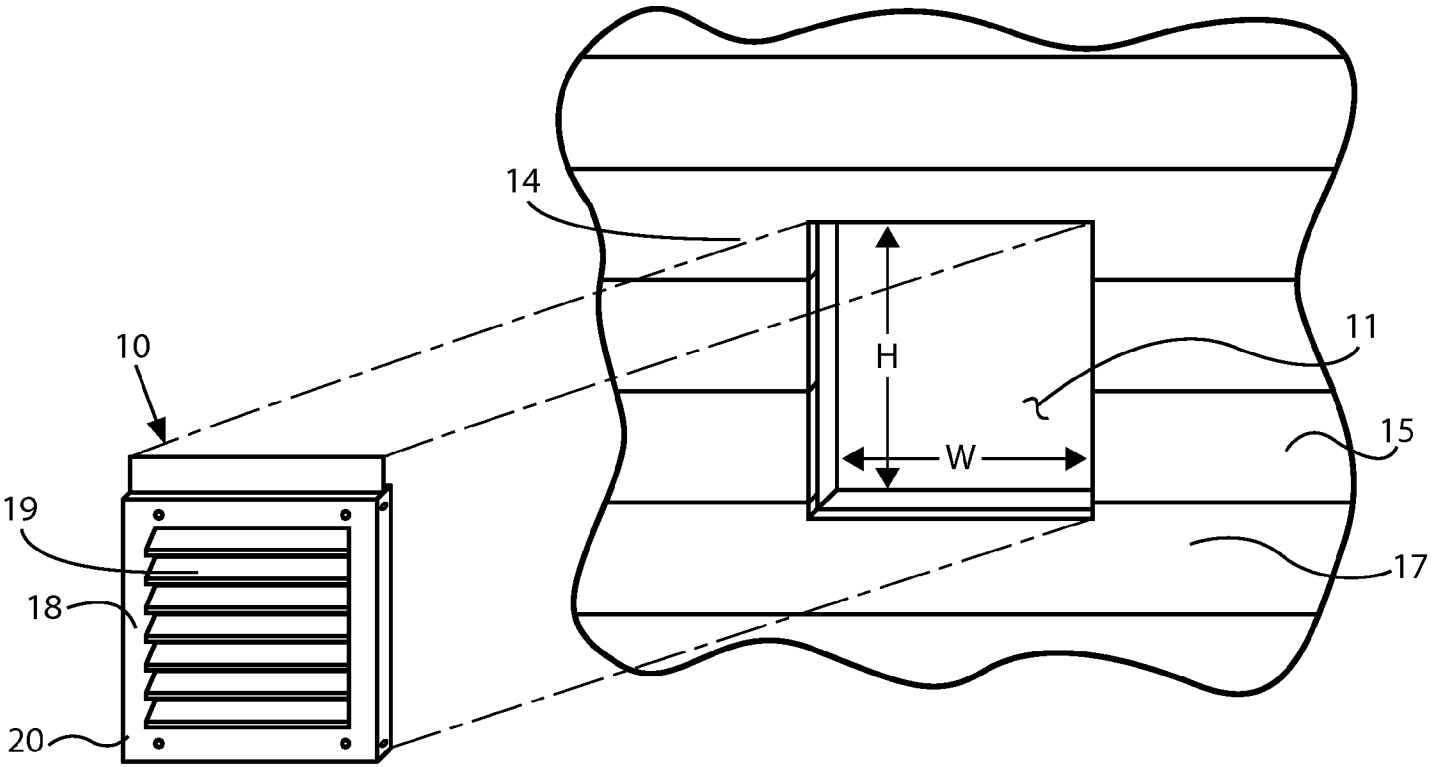
FIG. 1 is an exploded perspective view showing an exemplary embodiment of the present invention in conjunction with a vent opening.

Referring to FIG. 1, there is shown an exemplary embodiment of the present invention louvered vent cover 10. The louvered vent cover 10 is used to obstruct a vent opening 11 present in a building. The vent opening 11 exists within a finished wall. That is, the exterior of the vent opening 11 is surrounded by siding 15. Depending upon the type of building construction and the age of the building construction, the vent opening may also be framed by decorative trim.

In the illustrated embodiment, the vent opening 11 is present in a finished exterior wall of modern construction. That is the vent opening 11 is present in a wall framed with two-by-four lumber, covered in sheathing panels and then sided using vinyl siding. The vent opening 11 defines an open space having a predetermined width W and a predetermined height H. The vent opening 11 is defined by an inner peripheral wall 14 that follows the outline of the vent opening 11.

The louvered vent cover 10 has a peripheral frame 18. The peripheral frame 18 has a length and width that is slightly smaller than that of the vent opening 11. Consequently, the peripheral frame 18 is sized to pass into the vent opening 11. The peripheral frame 18 has a face surface 20 that faces forward away from the vent opening 11. An air permeable structure 19 is present inside the peripheral frame 18. The air permeable structure 19 can be any perforated or slatted construction used in construction venting. In the shown embodiment, the air permeable structure 19 is configured as a louvered structure.

The peripheral frame 18 and air permeable structure 19 can be made of wood or stamped from a sheet of aluminum. In the preferred embodiment, the entire replacement ventilation cover 10 is preferably molded from plastic. In this manner, the replacement ventilation cover 10 can be made in a very cost efficient manner. Furthermore, the replacement ventilation cover 10 will be lightweight and weather resistant.

As has been mentioned, the peripheral frame 18 has a width and height that is only slightly smaller than the vent opening 11. Consequently, when the louvered vent cover 10 is inserted into the vent opening 11, the peripheral frame 18 just passes into the vent opening 11. However, the louvered vent cover 10 cannot be directly pressed into vent opening 11. A tab 17 extends upwardly from the top rail 19 of the peripheral frame 18. The tab 17 get tucked under the siding 15 as the louvered vent cover 10 is installed, as will later be described in more detail.

Once the tab 17 is tucked under the siding 15, the louvered vent cover 10 is advanced into the vent opening 11 until the face surface 20 of the peripheral frame 18 lays in the same plane as the beginning of the vent opening 11.

Figure 2:
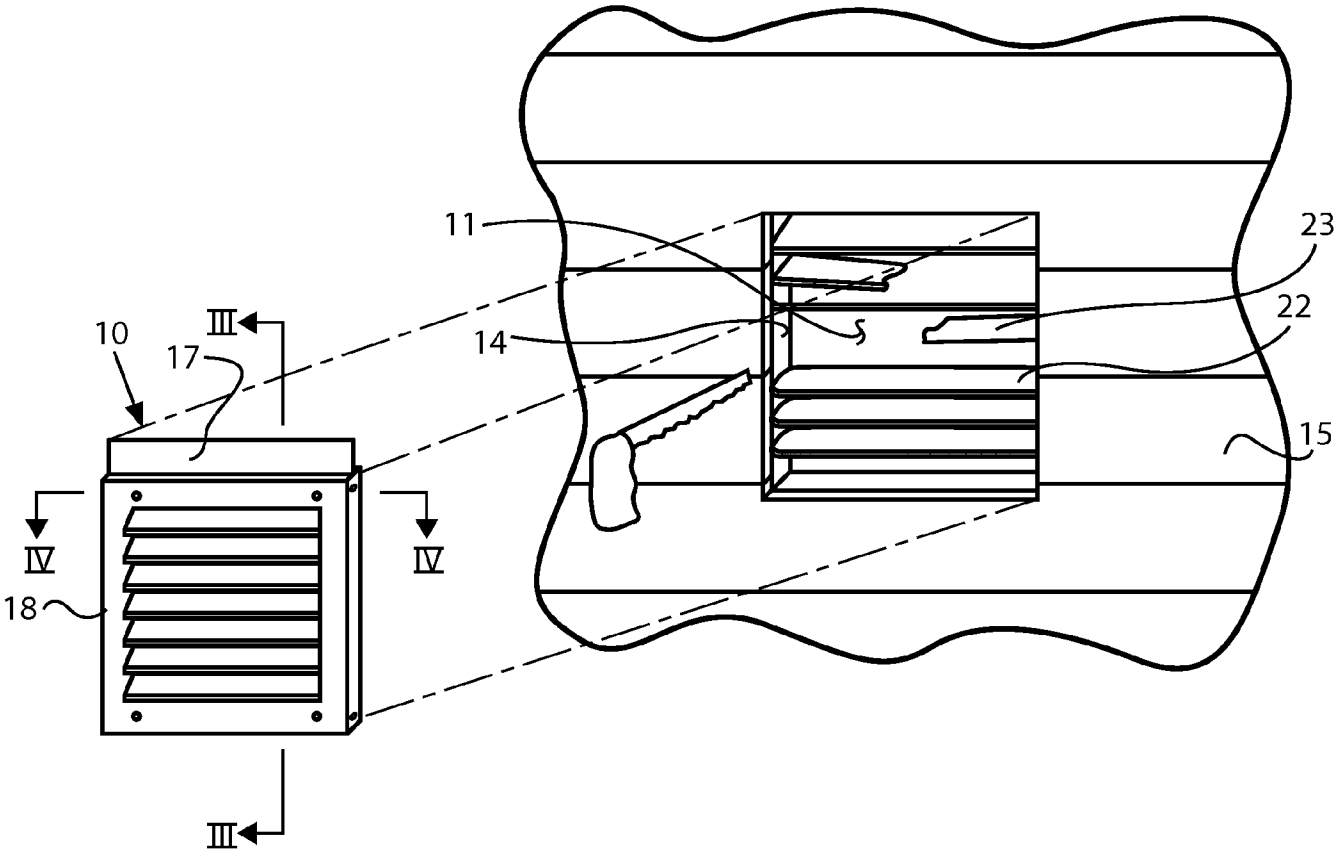
FIG. 2 shows the embodiment of the present invention that is shown in FIG. 1 with the vent opening that is covered by an old, damaged ventilation cover.

Referring to FIG. 2, it will be understood that the present invention louvered vent cover 10 is an aftermarket product that is intended to replace a broken existing vent cover 22. In a structure where there is a typical prior art vent cover 22 that needs replacement, the broken louvers 23 are cut out of the vent cover 22, without removing the existing vent cover 22 in its entirety. The broken louvers 23 can be cut away using a saw or utility knife, depending upon the material of the broken louvers 23. Once the broken louvers 23 are removed, there is a vent opening 11, such as is shown in FIG. 1.

Figure 3:
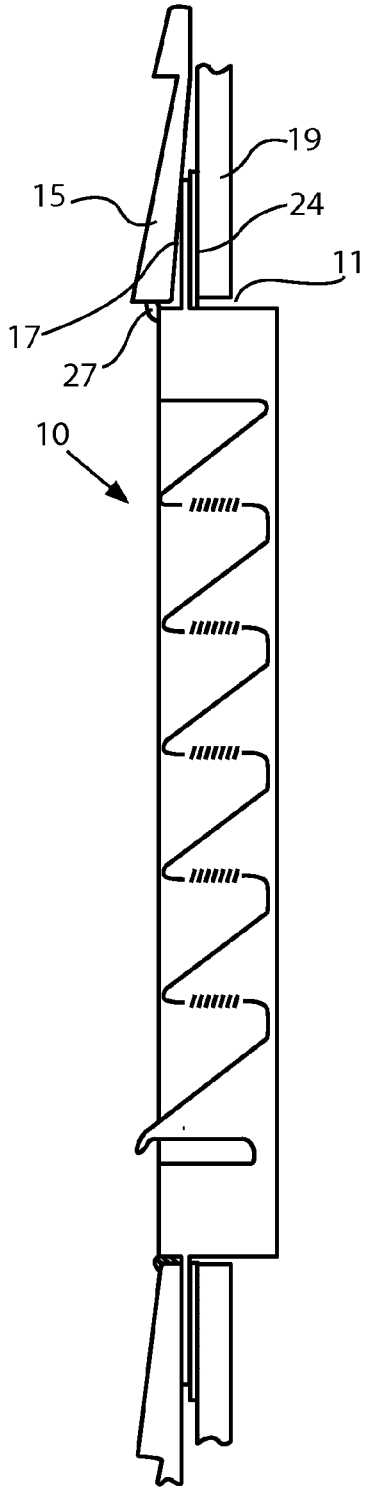
FIG. 3 is a cross-sectional view of the embodiment of FIG. 2, viewed along section line 3-3 and shown inserted into a vent opening.

Referring to FIG. 3, it can be seen that once the old louvers are cut away, all exposed pieces of the old vent cover are cut away until only the nailing flange 24 remains in place under the surrounding siding 15.

The siding 15 surrounding the vent opening 11 is nailed directly to the sheathing panels 19 of the wall, which are typically plywood. The sheathing panels 19 are nailed to the construction framework of the wall. Surrounding the vent opening 11, the sheathing panels 19 are separated from the siding 15 by the presence of the nail flange 24 of the old vent cover. Using this separation, a contractor can place a crowbar or wedge in between the sheathing panel 19 and siding 15 at the top of the vent opening 11. With little effort, the contractor should be able to create a gap between the sheathing 19 and the siding 15 of about $1/8^{th}$ of an inch. Once this gap is created, the tab 17 at the top of the replacement louvered vent cover 10 is angled into the gap. The louvered vent cover is then pressed into the vent opening 11, until the peripheral frame 18 of the replacement louvered vent cover 10 is flush with the sheathing panels 19 under the siding 15.

Figure 4:
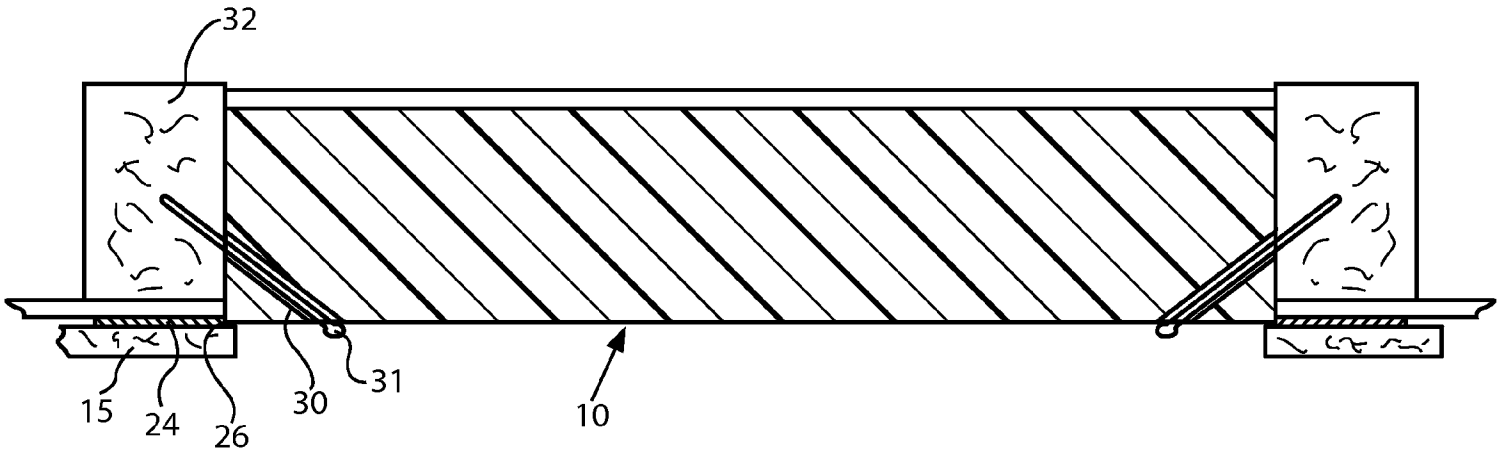
FIG. 4 is a cross-sectional view of the present invention ventilation cover of FIG. 2, viewed along section line 4-4 and shown inserted into a vent opening.

Referring to FIG. 2, FIG. 3 and FIG. 4 in unison, it will be understood that the replacement louvered vent cover 10 is sized to fit just within the vent opening 11 that has been created. The peripheral frame 18 of the replacement louvered vent cover 10 passes into the vent opening 11. The replacement louvered vent cover 10 passes into the vent opening 11 atop the remnants of the old vent cover 22. The replacement louvered vent cover 10 is advanced into the vent opening 11 until the peripheral frame 18 comes to lay in the same plane as the front edge 26 of the existing opening. A gap that is preferably no wider than ¼ inch exists between the interior of the venting opening 11 and the peripheral frame 18 of the replacement louvered cover 10. This gap is sealed by a bead of caulk 27. The peripheral frame 18 of the replacement louvered cover 10 does not contact the siding 15 surrounding the vent opening 11 and enables the replacement louvered vent cover 10 to seat properly in the vent opening 11.

Nail guides 30 are formed into the peripheral frame 18 of the replacement louvered cover 10. The nail guides 30 are reinforced conduits for nails 31. The nail guides 30 hold and direct nails 31 at a particular angle so that the nails 31 will pass into the surrounding construction framework 32 of the vent opening 11 when hammered. The nail guides 30 hold the nail at an acute angle relative to the plane of the peripheral frame 18. The nail guides 30 are positioned approximately one inch in from the front of the corners of the peripheral frame 18. At such an angle and position, any nail 31 or screw driven through the nail guides 30 will enter the construction framework 32 that surrounds the vent opening 11. In this manner, the replacement louvered vent cover 10 can be anchored directly to the construction framework 32 of the building. The reinforced nail guides 30 prevent the structure of the replacement louvered vent cover 10 from cracking or otherwise becoming damaged as a nail or screw is driven into the construction framework 32.

To install the replacement louvered vent cover 10, the broken louvers 23 from an old vent cover 22 are cut away, such as is shown in FIG. 2. This creates a vent opening 11, such as is shown in FIG. 1. The creation of the vent opening 11 does not disrupt the siding 15 surrounding the vent opening 11. Furthermore, the nailing flange 24 of the old vent cover 22 are left in place.

The replacement louvered vent cover 10 is inserted into the opening made in the old vent cover 22, such as is shown in FIG. 3 and FIG. 4. Referring to FIG. 3, it can be seen that the replacement louvered vent cover 10 is then either nailed or screwed into place by driving a nail or screw through the nail guides 30 in the replacement louvered vent cover 10.

It will therefore be understood that using the present invention replacement louvered vent cover 10, a damaged old vent cover 22 can be quickly replaced using only a small amount of time and a small amount of labor. Furthermore, the installation of the replacement louvered vent cover 10 has no effect on the siding 15 surrounding the vent opening 11.

In the embodiment of the present invention thus illustrated, the replacement louvered vent cover 10 is a static structure. Consequently, different models of the louvered vent cover must be made for vent openings of different sizes.

Figure 5:
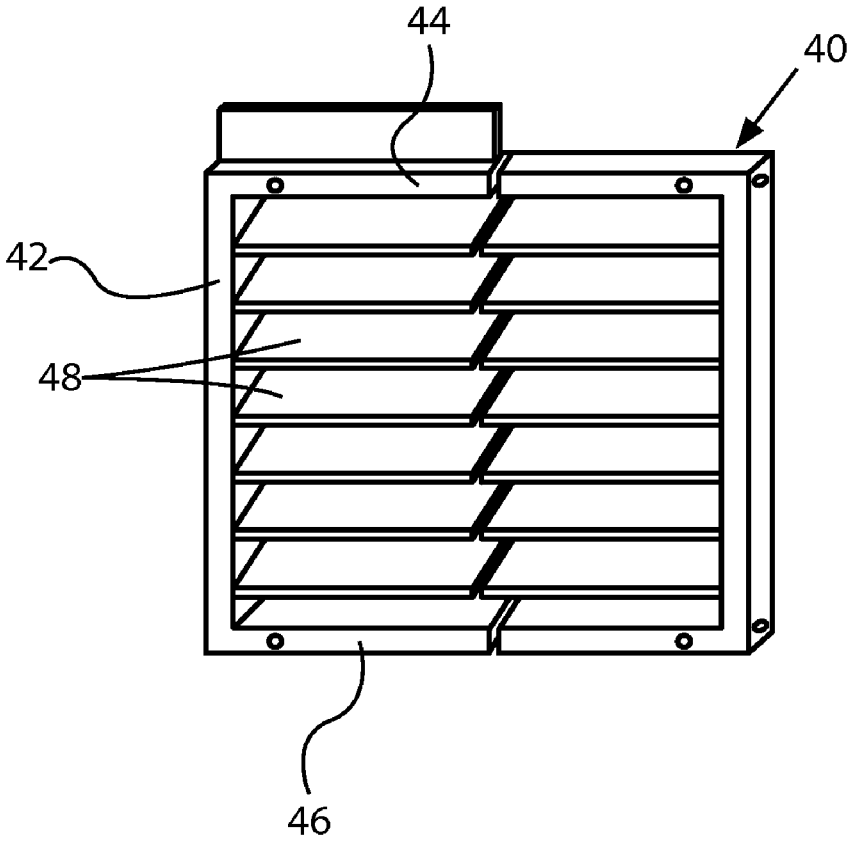
FIG. 5 is a perspective view of an alternate embodiment of a replacement ventilation cover.

Referring to FIG. 5, an alternate embodiment of a louvered vent cover 40 is shown. In this embodiment, the louvered vent cover 40 has a faceplate 42 that includes a top rail 44 and a bottom rail 46. Both the top rail 44 and the bottom rail 46 have a telescopic construction that enables the lengths of these elements to be selectively adjusted.

Since the length of the faceplate 42 can be selectively adjusted, the louvers 48 must also be adjustable in length. In the shown embodiment, the louvers 48 are also made with a telescoping construction so that the louvers 48 can expand and contract with the top rail 44 and bottom rail 46 of the faceplate 42.

By providing a replacement louvered vent cover 40 that can be selectively adjusted in length, a single replacement louvered vent cover can be used to cover a large variety of vent openings.

It should be understood that the embodiments of the present invention replacement louvered vent cover that are illustrated are merely exemplary. The shape of the louvered vent cover need not be rectangular, but can be circular, oval, triangular or any other polygonal shape. It will also be understood that the number, size and configuration of the louvered vent is merely exemplary. The illustrated louvers are intended to be exemplary of any perforated surface that allows airflow but deters the entrance of animals, insects and rain. All such variations, modifications and alternate embodiments are intended to be included within the scope of the present invention as defined by the claims.

What is claimed is:

1. In a building having an exterior wall containing vertical framing studs, sheathing and exterior siding that covers said sheathing, wherein a damaged louvered vent cover is disposed over a vent hole in said wall between adjacent vertical studs, a method of repairing said damaged ventilation cover comprising the steps of:

cutting an opening in the damaged ventilation cover wherein remaining segments of said damaged ventilation cover are left mounted to said wall;

providing a replacement ventilation cover having a peripheral frame that fits into said opening;

advancing said peripheral frame into said opening until said peripheral frame is flush with said wall; and securing said replacement ventilation cover by driving a mechanical fastener through said replacement ventilation cover, through said remaining segments of said damaged ventilation cover and into said adjacent vertical studs of said wall.

2. The method according to claim 1, wherein said damaged ventilation cover has louvers and said step of cutting an opening in the damaged ventilation cover includes cutting said louvers out of said damaged ventilation cover.

3. The method according to claim 1, wherein said step of providing a replacement ventilation cover includes providing a replacement ventilation cover that has nail guides formed therein.

4. The method according to claim 3, wherein said step of securing said replacement ventilation cover includes driving a mechanical fastener through said nail guides.

5. The method according to claim 1, wherein said step of providing a replacement ventilation cover includes providing a replacement ventilation cover that has a thin tab extending upwardly from a top surface.

6. The method according to claim 5, wherein said step of securing said replacement ventilation cover includes creating a gap for said tab in said wall between said sheathing and said siding and inserting said tab into said gap.

7. The method according to claim 1, wherein said step of providing a replacement ventilation cover includes the substeps of:

providing a peripheral frame having a forward edge and defining an interior area, wherein said forward edge of said peripheral frame lays in a common plane; wherein an air permeable construction is disposed within said interior area of said peripheral frame; and wherein nail guides are disposed on said peripheral frame that face toward said interior area, wherein said nail guides hold nails at an acute angle relative said common plane.

8. The method according to claim 7, wherein said peripheral frame and said air permeable construction are integrally molded from plastic.

9. The method according to claim 7, wherein said air permeable construction includes parallel louvers.

10. The method according to claim 7, further including the substep of providing a tab extending upwardly from said peripheral frame.

11. A method of repairing a damaged ventilation cover that is being used to cover a vent opening in a wall covered with siding, said method comprising the steps of:

removing a central portion of said damaged ventilation cover, therein creating a central opening that leads into said vent, wherein remaining peripheral portions of said damaged ventilation cover remain;

inserting said replacement ventilation cover into said central opening without having said replacement ventilation cover overlap said siding on said wall; and driving fasteners through said replacement ventilation cover and into said wall through said remaining peripheral portions of said damaged ventilation cover, wherein said fasteners enter said wall from said vent behind said siding.

12. The method according to claim 11, wherein said damaged ventilation cover has louvers and said step of removing a central portion of said damaged ventilation cover includes cutting said louvers out of said ventilation cover.

13. The method according to claim 11, wherein said replacement ventilation cover includes:

a peripheral frame having a forward edge and defining an interior area, wherein said forward edge of said peripheral frame lays in a common plane; and an air permeable construction disposed within said interior area of said peripheral frame.

14. The method according to claim 13, wherein said replacement ventilation cover further includes nail guides disposed on said peripheral frame that face toward said interior area, wherein said nail guides hold nails at an acute angle relative said common plane.

15. The method according to claim 14, wherein said step of driving fasteners through said replacement ventilation cover includes driving nails through said nail guides.

* * * * *